US008180091B2

(12) United States Patent
Sokolich et al.

(10) Patent No.: US 8,180,091 B2
(45) Date of Patent: May 15, 2012

(54) HEADPHONE

(75) Inventors: W. Gary Sokolich, Newport Beach, CA (US); Stephen D. Gilder, Chula Vista, CA (US); Bradley K. Witt, Chula Vista, CA (US); Claes Ingemar Haglund, Ödåkra (SE)

(73) Assignee: Sperian Hearing Protection, LLC (Delaware Limited Liability Company), San Diego, CA (US)

( * ) Notice: Subject to any disclaimer, the term of this patent is extended or adjusted under 35 U.S.C. 154(b) by 1330 days.

(21) Appl. No.: 11/880,559

(22) Filed: Jul. 23, 2007

(65) Prior Publication Data

US 2009/0028348 A1 Jan. 29, 2009

(51) Int. Cl.
*H04R 25/00* (2006.01)

(52) U.S. Cl. ..... 381/371; 381/309

(58) Field of Classification Search ..... 381/371, 381/309, 370

See application file for complete search history.

(56) References Cited

U.S. PATENT DOCUMENTS

| | | | | |
|---|---|---|---|---|
| 6,151,717 | A | 11/2000 | Lindgren et al. | |
| 7,340,071 | B2 * | 3/2008 | Huang | 381/309 |
| 7,436,973 | B2 * | 10/2008 | Liao | 381/370 |
| 7,466,838 | B1 * | 12/2008 | Moseley | 381/370 |

* cited by examiner

*Primary Examiner* — Jianchun Qin
(74) *Attorney, Agent, or Firm* — Conley Rose, P.C.; Kristin Jordan Harkins

(57) ABSTRACT

A headphone that is especially useful to test the efficacy of an earplug installed in an ear canal, by using the headphone to produce sound and by sensing sound pressure at the ear drum despite the presence of the earplug. Applicant uses the speaker (42) in the headphone to produce a smooth and reasonably "flat" frequency response by reversing the speaker orientation. In the reversed orientation, the front side of the speaker diaphragm (50) faces into the headphone cup and away from the ear. The rear side of the speaker that has a circle of holes (52), faces toward the ear. The headphone frame has a cylindrical passage (40) for carrying sound to the person's ear, which has an outer end (78) that is tapered to encompass the holes in the speaker back side (44). The axial distance (L) from the speaker rear side to the ear, is at least 0.6 inch to accommodate the protruding end of an earplug.

14 Claims, 3 Drawing Sheets

HEADPHONE

BACKGROUND OF THE INVENTION

One way to test earplugs is to insert an earplug in an ear canal of a person, or of a manikin head with an ear simulator that simulates the acoustic characteristics of the ear and that has a sound detector. Then sound of a controlled amplitude is applied to the person or manikin. The amplitude of sound detected by the person or ear simulator is noted in relation to the amplitude of sound applied to the outside of the ear canal, to indicate the effectiveness of the earplug. When a person who is going to wear an earplug wishes to test it, it is desirable that that person test it on him/herself.

One problem encountered when applying sound through an earphone, or headphone, is that the amplitude of sound applied to the outside of the ear may not be sufficiently high over the frequency range of interest. One test used in the industry measures the blocking ability of earplugs at five frequencies: 250 Hz, 500 Hz, 1000 Hz, 2000 Hz and 4000 Hz. It would be desirable if the amplitude of sound output from the headphone were approximately the same at each of these frequencies for a constant electrical power input. It also would be desirable if the headphone were as efficient as possible. Although low speaker output can be compensated for by a higher power input, the speaker output at higher amplitudes will be distorted, and an excessively high electrical input can damage the speaker.

Conventional headphones place the speaker so it lies close to the outer ear. During earplug effectiveness tests, the earplug can touch the headphone grille and prevent the headphone from fully seating on the ear, or disturb the earplug installation, or make the wearer uncomfortable.

SUMMARY OF THE INVENTION

In accordance with one embodiment of the invention, a headphone is provided that produces a high sound level (at least 120 dB SPL) at the wearer's ear, over a range of interest of 250 HZ to 4000 HZ, for a 25 mW electrical input to its speaker (by applying one volt RMS). Applicant mounts the speaker of the headphone in a reverse orientation from the usual one, with the front of the speaker diaphragm facing away from the wearer's ear, and with the rear of the speaker which has holes, facing toward the wearer's ear. The holes in the rear of the speaker lie in a circle, and a tube in the headphone frame has an outer end with a diameter that encompasses the ring of holes to direct sound from the holes to the person's ear. The tube in the headphone frame has a tapered outer end that is enlarged to encompass the ring of holes, with the ear end of the tube being of smaller diameter than the speaker end. The tube in the headphone frame has a length of at least 0.6 inch to accommodate a long projecting end of an earplug in the wearer's ear.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
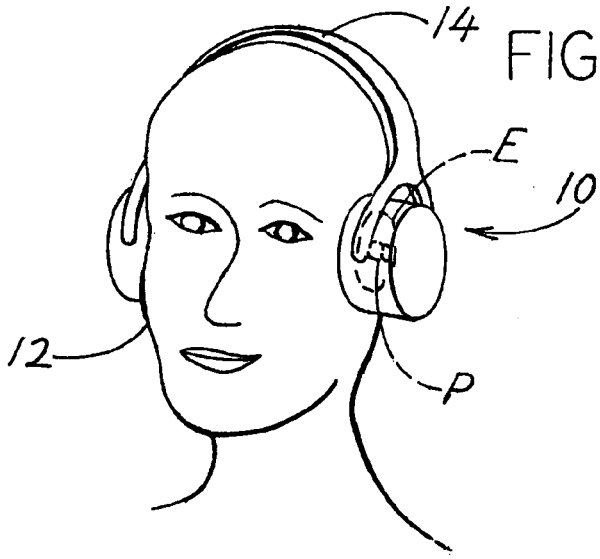
FIG. 1 is an isometric view of a headphone set of the present invention, shown being worn.

FIG. 1 shows a pair of headphones 10 of the invention worn on a person or manikin 12, with a band 14 extending around the head to press each headphone against an ear E at the side of the head. The headphones may be constructed especially to produce loud sounds that are blocked by earplugs P lying in the ear canals of the head. In a test, the head wears earplugs and the headphones are placed around the ears. Power of a known frequency and amplitude is applied to the headphones to energize a speaker in each headphone, and the amount of sound that passes through the ear plugs is determined by objective or subjective means.

Figure 2:
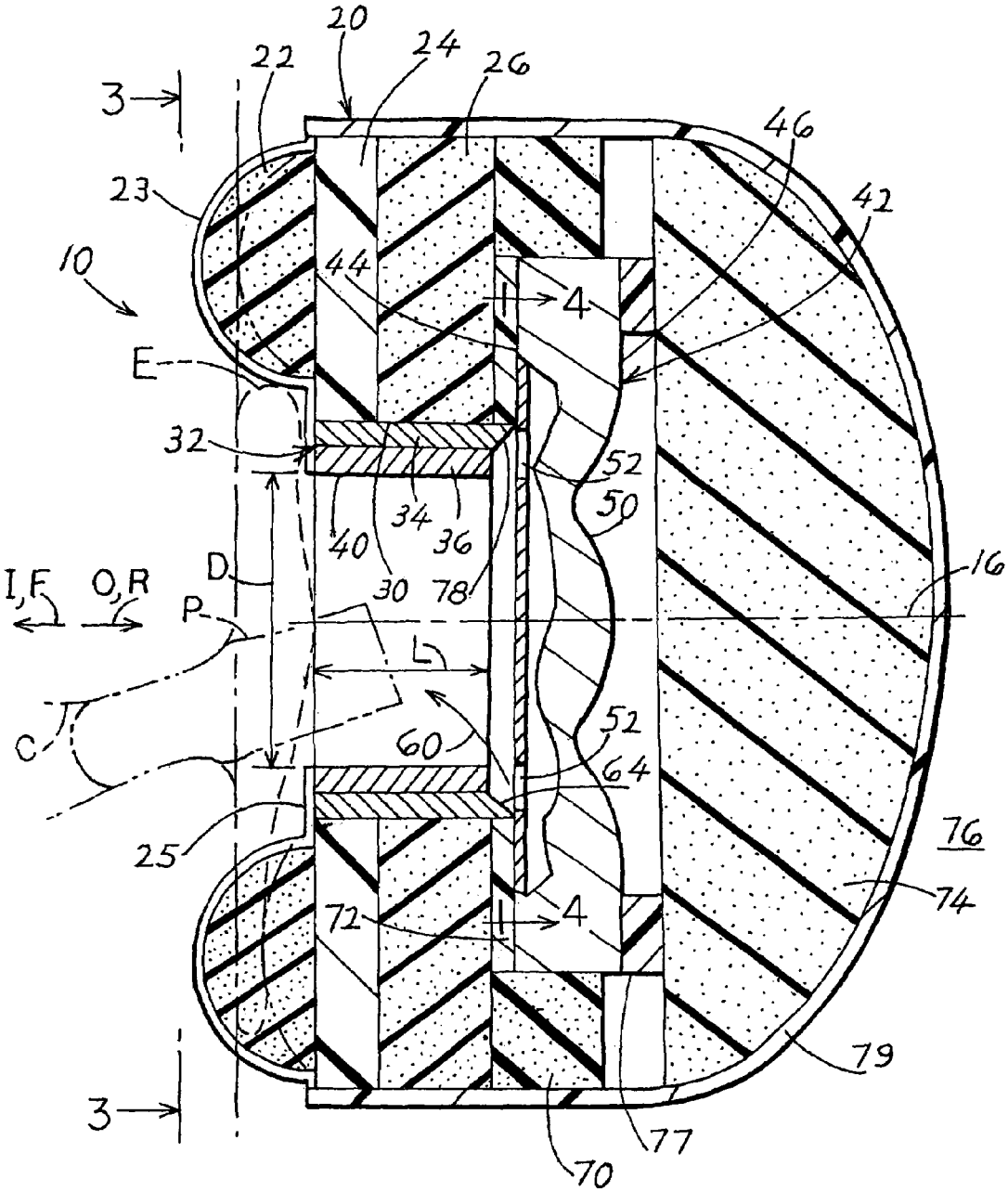
FIG. 2 is a sectional view of one of the headphones of FIG. 1.

FIG. 2 shows the construction of one of the headphones 10, which is of elliptical shape as viewed along its axis 16. Except for pivotal mounts, each headphone is symmetrical about a horizontal plane that passes through the headphone axis 16. The axis 16 extends in inward I or forward F, and outward O or rearward R directions. The headphone includes a frame 20 comprising a soft elastomeric cushion 22 at a headphone front end 23, a rigid plastic front plate 24, and a foam plate 26. These plates 20, 22, 24, 26 have aligned holes 30. A rigid (at its inside) tube 32 formed by two interfitting rigid plastic tubes 34, 36 extends through the aligned holes to a rubber front sheet 25 to form a frame passage 40. A speaker 42 is mounted at the rear R end of the passage. Sound from the speaker moves through the passage to the wearer's ear canal C that lies near the center of his outer ear E. The ear canal C may be blocked by an earplug P, and the sound level reaching the inner end of the wearer's ear canal is detected.

In accordance with the present invention, the speaker 42 is mounted in a reverse orientation from the usual orientation of a speaker. The speaker has first and second sides 44, 46. A diaphragm 50 that lies at the second side 46, vibrates inward and outward to generate sound, while the first side 44 of the speaker has holes 52 that allow the sound generated behind the diaphragm to escape and propagate in to the tube 32. In almost all prior headphones, the second side 42 containing the diaphragm faces toward the ear. In the present invention, the speaker is oriented so its diaphragm faces away from the ear.

Figure 4:
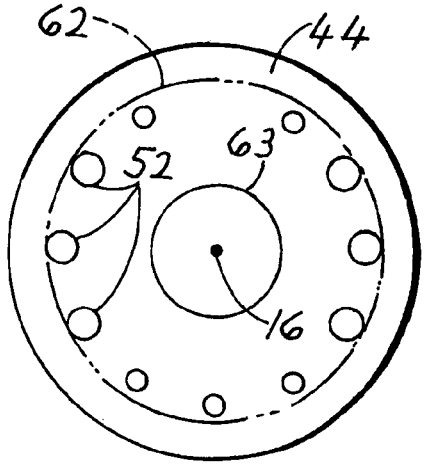
FIG. 4 is a view of a rear side of the speaker of FIG. 2, taken on line 4-4 of FIG. 2.
Figure 3:
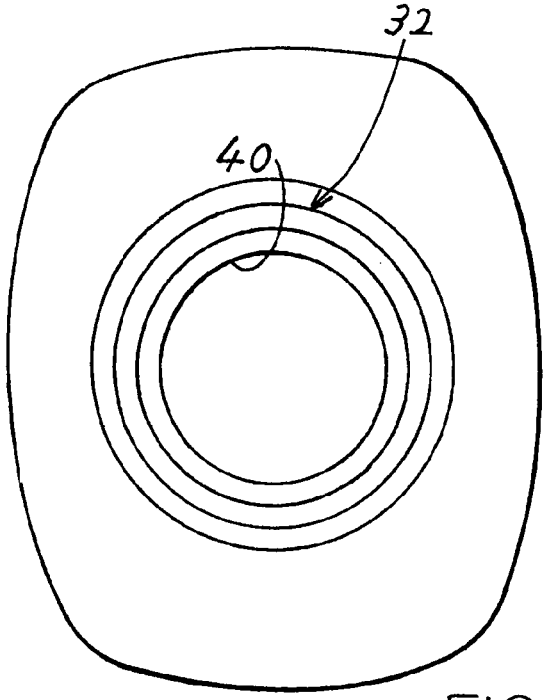
FIG. 3 is a view taken on line 3-3 of FIG. 2.

FIG. 4 shows that the holes 52 in the first side 44 of the speaker lie within a circle 62 which is centered on a speaker magnet 63. In the particular speaker shown (made by CUI Inc., of Tualatin, Oreg.) a radially (with respect to axis 16) outer side of all of the holes lie against the inside of the circle. In accordance with the invention, applicant uses the sound emanating from the holes 52 in the first side of the speaker to produce the sound that is transmitted to the ear of the headphone wearer. The tube 32 (FIG. 2) that forms the passage in the headphone, has a rear, or speaker end 64 that encompasses the circle of holes 62. The speaker end 78 of the tube is tapered in diameter to be of progressively smaller diameter at more forward locations. As a result, all sound emanating from the holes in the first side 44 of the speaker enters the tube 32 in phase and is directed toward the wearer's ear as indicated by arrow 60.

The headphone includes a sound absorbent foam at 26, 70, 74 that occupies the empty space within the ear cup. The rear side of the speaker is glued to the tapered rear end of the tube 32. A spacer 77 is preferred to leave a small air space rearward of the diaphragm 44 so as to allow free movement of the diaphragm. A plastic outer cup 79 surrounds the rear and sides of the headphone and serves to attenuate external environmental air bourne sound.

The tube 32 that carries sound from the first, or ear side of the speaker to the ear, has a tapered rear end 78, which is of progressively greater diameter at progressively more rearward locations therealong. This allows the tube ear end to be of smaller diameter to increase the level of sound at the ear, while having a large enough passage rear end to encompass the holes in the first side of the speaker. The inside diameter D of the tube is no more than 30 millimeters along most of its length, with the tapered rear end having a maximum diameter of no more than 45 mm. The actual diameter D is 25 mm and the maximum diameter at the tapered rear end is 40 mm to match the circle 62 (FIG. 4) at the outside of the holes of 40 mm diameter. The diameter D is less than one-third the vertical height of the headphone.

The headphone shown in FIG. 2, has a passage length L of 0.75 inch between the front, or ear end of the tube 32 which lies at the rear of the cushion 22, and the rear side 44 of the speaker. This length accommodates the projecting rear ends of most earplugs P. The headphone contains a passage that is at least 0.5 inch (12.7 mm), and preferably over 0.6 inch (15 mm) long to accommodate the protruding rear end of an earplug.

Figure 5:
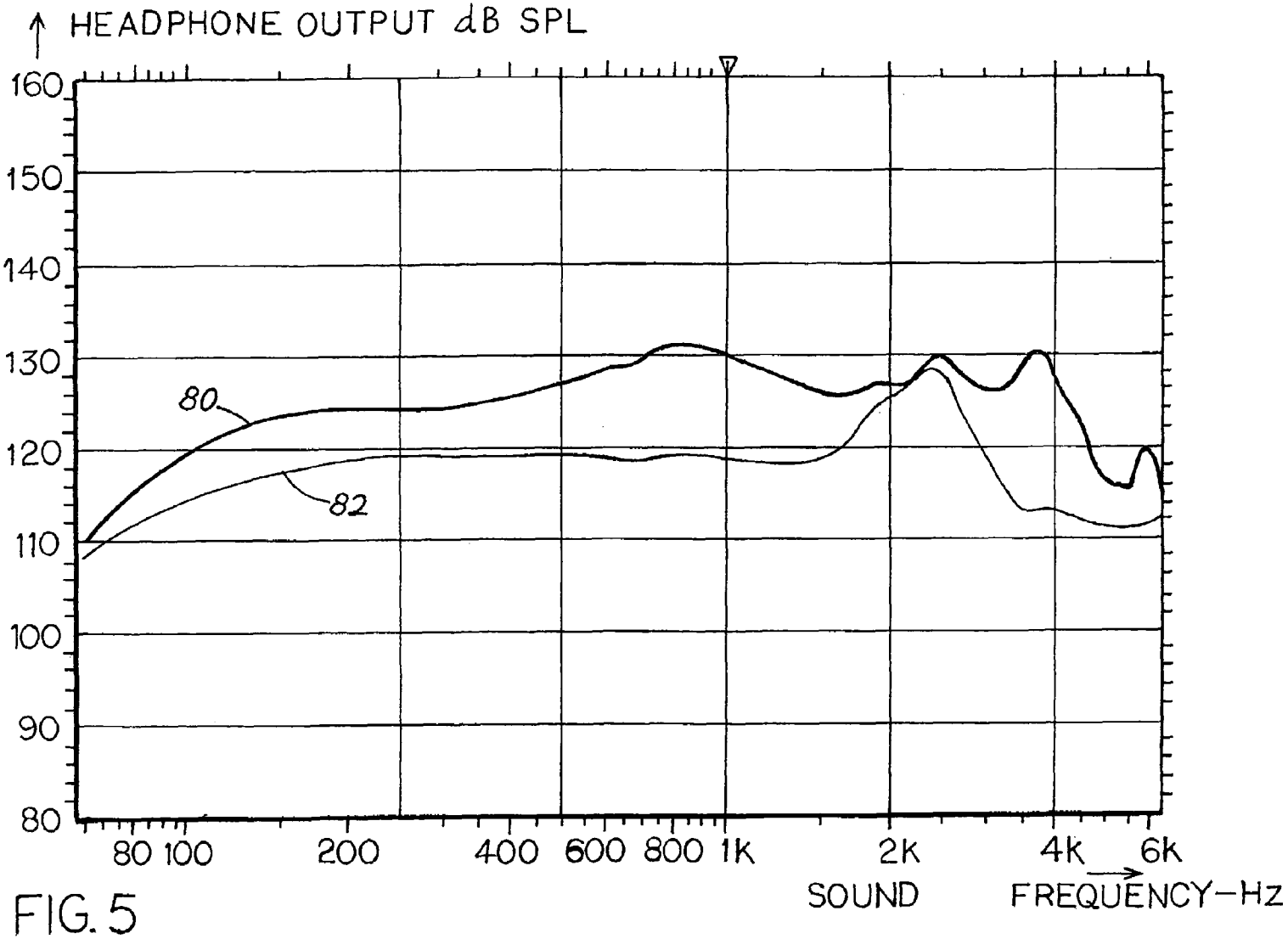
FIG. 5 is a graph showing a real ear response produced by the headphone of the present invention and comparing it to the response produced by a commercially available headphone that is used for audiometric testing.

FIG. 5 includes graphs 80, 82 showing the frequency response of the headphone as measured on a person's ear by means of a probe tube microphone at the eardrum. The vertical axis shows the sound pressure level in decibels (re 20 μPa), and the horizontal axis shows the frequency of the sound. Graph 80 shows the frequency response of the headphone shown in FIG. 2, for an applied voltage of 1 volt RMS (corresponding to an applied power of 25 mW). Graph 82 shows the frequency response of a Sennheiser headphone model HDA-200 audiometric headphone for an applied voltage of 1 volt RMS. The graphs show that in the test frequency range of 250 Hz to 4000 Hz, the acoustic output of applicant's headphone (of output in dB for a constant voltage and for a constant power input) of FIG. 2 is greater than that of the Sennheiser headphone by 5 to 10 dB over most of the frequency range from 250 Hz to 4 KHz.

Thus, the invention provides a headphone that is especially useful in testing earplugs. The headphone includes a speaker that is mounted in a reverse orientation, with the diaphragm facing rearwardly, away from the passage that leads to an ear. The opposite side of the speaker has holes all centered on a circle, and the passage in the headphone frame comprises a tube with a rear end that encompasses (extends around) all of the holes. The passage is formed by a rigid tube with a length parallel to the axis of at least 0.5 inch to the speaker, to accommodate the protruding end of an earplug.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A headphone which includes a frame that forms a frame passage, a cushion mounted on an inner end of said frame for pressing against a location on a person that lies around the person's ear canal, said frame has an outer wall that blocks sound, and said headphone has a speaker that lies in said frame and that has a speaker diaphragm side comprising a diaphragm that vibrates inward and outward to generate sound and an opposite speaker hole side that forms a second wall with a plurality of holes, wherein:

said speaker is mounted with said speaker second wall that has holes facing inwardly toward the person's ear canal and with said holes opening to said frame passage, and with said speaker diaphragm side that comprises a diaphragm, facing outwardly away from the person's ear canal;

the frame further comprising a rigid tube that forms the frame passage extending from the cushion to the speaker, wherein the rigid tube is located on a central axis of the frame;

wherein the rigid tube has a constant diameter for most of its length, but has a speaker end tapered in diameter to have progressively smaller diameters at progressively more inward locations therealong; and wherein the holes in the speaker second wall lie within a hole circle and the tapered speaker end of the tube has an outward end diameter at least as great as the hole circle.

2. The headphone described in claim 1 wherein:

the rigid tube has an inside of a diameter of not more than 1.5 inches along most of its length which extends from said speaker second wall that has holes to the inner end of said headphone, whereby to direct sound toward a person's ear canal.

3. The headphone described in claim 2 wherein:

said tube has a length, from said speaker second wall that has holes to an outer end of said cushion, of at least 0.5 inch.

4. The headphone described in claim 1 wherein:

said tube has a length, from said sneaker second a that has holes to an outer end of said cushion, of at least 0.5 inch.

5. The headphone described in claim 1 further comprising a sound absorbent foam located between the speaker diaphragm side and the frame outer wall.

6. The headphone described in claim 5;

wherein the tube has an inside diameter of not more than 1.5 inches along most of its length from the cushion to an inward end of the tapered speaker end; and wherein the tube has a length, from said speaker second wall to an outer end of said cushion, of at least 0.5 inch.

7. A headphone which includes a frame with a central axis, a cushion at the front end of said frame for pressing against a side of person's head around the ear canal and, with a rear end that is closed to block the passage of sound, with a passage extending along said central axis, and with a speaker lying at a rear end of said passage, wherein:

said headphone includes a rigid tube that forms said passage and that extends from a rear end of said cushion to said speaker, said rigid tube having an inside diameter of not more than 30 millimeters;

said speaker has a first side that has a wall with a plurality of holes and an opposite second side with a diaphragm thereat, said first facing forwardly towards the person's ear canal and said holes opening to a rear end of said rigid tube; and the rigid tube has a constant diameter for most of its length, but has a speaker end tapered in diameter to have progressively smaller diameters at progressively more inward locations therealong; and wherein the holes in the speaker first side wall lie within a hole circle and the tapered speaker end of the tube has an outward end diameter at least as great as the hole circle.

8. The headphone described in claim 7, wherein:

said rigid tube has a length of at least 0.5 inch.

9. The headphone described in claim 7 further comprising a sound absorbent foam located between the second diaphragm side of the speaker and the frame rear end.

10. A headphone which includes a frame with a central axis, a cushion at the front end of said frame for pressing against a side of person's head around the ear canal and, with a rear end that is closed to block the passage of sound, with a passage extending along said central axis, and with a speaker lying at a rear end of said passage, wherein:

said headphone includes a rigid tube that forms said passage and that extends from a rear end of said cushion to said speaker, said rigid tube having a length of at least 0.5 inch;

said speaker has a first side that has a wall with a plurality of holes and an opposite second side with a diaphragm thereat, said first side facing forwardly towards the person's ear canal and said holes opening to a rear end of said rigid tube; and the rigid tube has a constant diameter for most of its length, but has a speaker end tapered in diameter to have progressively smaller diameters at progressively more inward locations therealong; and wherein the holes in the speaker first side wall lie within a hole circle and the tapered speaker end of the tube has an outward end diameter at least as great as the hole circle.

11. The headphone described in claim 10, wherein:

said rigid tube has a length of at least 0.6 inch.

12. The headphone described in claim 11 wherein the tube has an inside diameter of not more than 1.5 inches along most of its length from the cushion to an inward end of the tapered speaker end.

13. The headphone described in claim 10 wherein the tube has an inside diameter of not more than 1.5 inches along most of its length.

14. The headphone described in claim 10 further comprising a sound absorbent foam located between the second diaphragm side of the speaker and the frame rear end.

* * * * *

UNITED STATES PATENT AND TRADEMARK OFFICE

CERTIFICATE OF CORRECTION

PATENT NO. : 8,180,091 B2
APPLICATION NO. : 11/880559
DATED : May 15, 2012
INVENTOR(S) : W. Gary Sokolich et al.

It is certified that error appears in the above-identified patent and that said Letters Patent is hereby corrected as shown below:

Column 4, line 30, replace “sneaker” with --speaker--

Signed and Sealed this
Fourteenth Day of August, 2012

David J. Kappos

David J. Kappos
*Director of the United States Patent and Trademark Office*